US006683580B2

(12) United States Patent
Kuramoto

(10) Patent No.: US 6,683,580 B2
(45) Date of Patent: Jan. 27, 2004

(54) ANTENNA APPARATUS AND ELECTRONIC TOLL COLLECTION SYSTEM AND ELECTRONIC TOLL COLLECTION METHOD USING THE SAME

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/879,157

(22) Filed: Jun. 13, 2001

(65) Prior Publication Data

US 2001/0052880 A1 Dec. 20, 2001

(30) Foreign Application Priority Data

Jun. 14, 2000 (JP) ..... 2000-177757

(51) Int. Cl.[7] ..... H01Q 1/00; G08G 1/00
(52) U.S. Cl. ..... 343/721; 343/711; 340/928
(58) Field of Search ..... 343/711, 712, 343/721, 781, 786; 701/117; 340/928

(56) References Cited

U.S. PATENT DOCUMENTS 3,602,881 A * 8/1971 Bayne et al. ..... 340/31
5,598,171 A * 1/1997 Cole ..... 343/721
5,963,172 A * 10/1999 Pfizenmaier et al. ..... 343/721

FOREIGN PATENT DOCUMENTS

CA 2164031 9/1999
JP 8-221691 8/1996

* cited by examiner

*Primary Examiner*—Michael C. Wimer
(74) *Attorney, Agent, or Firm*—McGinn & Gibb, PLLC

(57) ABSTRACT

In an antenna apparatus and the electronic toll collection (hereinafter, abbreviated to an ETC) system using it, an antenna apparatus (2) is provided in a space over a lane (3) through which an automobile (1) having ETC on-vehicle equipment (10) passes. An antenna which the antenna apparatus has radiates a radio wave having a radio beam emitted area (21) of a radio wave to communicate with the ETC on-vehicle equipment and, thereby, electronic toll collection is performed for the passing automobile. It is an object of the present invention to provide an antenna apparatus which is controllable so that the ETC on-vehicle equipment is in the center of the radio beam emitted area of the antenna apparatus, and also to provide an ETC system using it. The antenna apparatus integrates an antenna and a light emitting unit. The light emitting unit emits a visible light (31) to the radio beam emitted area for communicating with the ETC on-vehicle equipment 10 mounted on the automobile along the center line within the radio beam emitted area. A sensor (40) can detect the automobile and can determine an emitted period of the visible light.

23 Claims, 12 Drawing Sheets

ANTENNA APPARATUS AND ELECTRONIC TOLL COLLECTION SYSTEM AND ELECTRONIC TOLL COLLECTION METHOD USING THE SAME

BACKGROUND OF THE INVENTION

The present invention relates to an antenna apparatus, and an electronic toll collection system and an electronic toll collection method using the antenna apparatus. More specifically, the present invention relates to an antenna apparatus capable of ensuring communication with on-vehicle equipment for electronic toll collection and of improving traffic jams to be smoothed, and to an electronic toll collection system and an electronic toll collection method using it.

As shown in FIG. 1, in the above-mentioned antenna apparatus and the electronic toll collection (hereinafter, abbreviated to an ETC) system using it, hitherto, an antenna apparatus 102 is provided in a space over a lane 3 through which an automobile 1 having an ETC on-vehicle equipment 10 passes. An antenna of the antenna apparatus 102 radiates a radio wave having a radio beam emitted area 21 to communicate with the ETC on-vehicle equipment 10 and, thereby, toll collection is electronically performed for the passing automobile 1.

Generally, the antenna apparatus 102 is disposed over a center line of the lane 3, and the ETC on-vehicle equipment 10 is placed in the center of a dashboard inside a front glass of the automobile 1. Thereby, the radio wave is accurately transmitted/received between the antenna apparatus 102 and the ETC on-vehicle equipment 10.

In order to reduce a communication error due to various radio interference noises, a radio beam pattern of the antenna is improved and a reflected wave is suppressed by laying a radio absorbing material, etc.

However, usually, the above-mentioned conventional antenna apparatus and the ETC system using it aim the radio beam emitted area of the antenna apparatus in the center line of the lane. Therefore, if the position of the ETC on-vehicle equipment mounted on the automobile is near a passenger seat and the automobile entering the lane is near the passenger seat side of the lane, there is a great possibility that communication for the ETC on-vehicle equipment is not accurately ensured. If it is incommunicable, the automobile is constrained to stop before an exit or to further reduce the speed and there is a problem in that the automobile cannot smoothly pass through the lane.

SUMMARY OF THE INVENTION

In order to solve the aforementioned problems, it is an object of the present invention to provide an antenna apparatus which is controllable so that the ETC on-vehicle equipment mounted on the automobile is in the center of the radio beam emitted area of the antenna apparatus, and also to provide an electronic toll collection (ETC) system using it.

According to the present invention, an antenna apparatus comprises an antenna through which a radio beam is emitted to have a predetermined-directionality, and a light emitting unit having a light emitted area of visible light within the center in the radio beam emitted area of the antenna. In this constitution, a driver of the automobile sensing the emission of the visible light regardless of day and night can pass the ETC on-vehicle equipment through the center of the emitted area of the visible light.

Also, when the visible light emitted from a light source in the light emitting unit in the antenna apparatus is emitted to a wall opposed to the antenna apart therefrom by a predetermined distance, the visible light is substantially circular-shaped, laterally-long-shaped, or vertically-long-shaped in the emitted area.

With respect to the arrangement of the antenna and the light emitting unit in the antenna apparatus, the antenna is in the center and the light emitting unit is around the antenna, for example, at least on one of upper, lower, right, and left sides and four corners. When the light emitting unit is placed on the upper side, lower side, right side, and left side, or on the four corners, the emitted shape of the visible light can be substantially rectangular in the emitted area.

The antenna apparatus may have a horn-type antenna and a sub-reflector which is held by a supporter in a parabola reflection mirror, and a light source of the light emitting unit may be substantially in the center of the sub-reflector.

According to one aspect of the present invention, the ETC system using any one of the above-mentioned antenna apparatus is characterized as follows in the antenna apparatus and the light source of the light emitting unit. The antenna apparatus is held to an arm of a column over a lane through which an automobile passes. And, when the radio beam emitted area of the antenna which the antenna apparatus has is directed to on-vehicle equipment for ETC which is mounted on the automobile, the light source of the light emitting unit emits the visible light to the center in the radio beam emitted area. Further, preferably, the ETC system has a sensor for detecting the entering direction of the automobile which enters the lane in front of the antenna, for driving the light emitting unit when the entrance of the automobile is detected, and for emitting the visible light from the light source of the light emitting unit.

According to another aspect of the present invention, the ETC system using any one of the aforementioned antenna apparatuses is characterized in that the system is provided for a crossing gate. The crossing gate is held to a column to cross the lane through which the automobile passes at the position to prevent the passage of the automobile. And, when the radio beam emitted area of the antenna which the antenna apparatus is directed to the on-vehicle for the ETC which is mounted on the automobile, the light source of the light emitting unit emits the visible light to the center of the radio beam emitted area. In this case, preferably, the ETC system further has a sensor for detecting that the automobile enters the lane, for driving the light emitting unit when the entrance of the automobile is detected, and for emitting the visible light from the light source of the light emitting unit. The light beam is emitted in the center in the radio beam emitted area of the antenna. Therefore, it is advantageous, in particular, when the lane or antenna apparatus cannot be accurately confirmed because the periphery is dark. Incidentally, the emission of the visible light can be economically and effectively provided, by using the sensor cutting off from the control of the ETC system.

The antenna apparatus other than the aforementioned ones is characterized in that the apparatus is a handy-type apparatus being connected to one end of an arm portion having therein a coaxial cable and a power source cable and used by an attendant for ETC. When the emitted area of light emitted from the light emitting unit is directed to the on-vehicle equipment being mounted on the automobile entering the lane for collecting a toll by the attendant, the toll collection is realized by the ETC system using the radio beam emitted through the antenna.

DESCRIPTION OF THE PREFERRED EMBODIMENTS

Now, several preferred embodiments of the present invention will be described with reference to the drawings.

Figure 1:
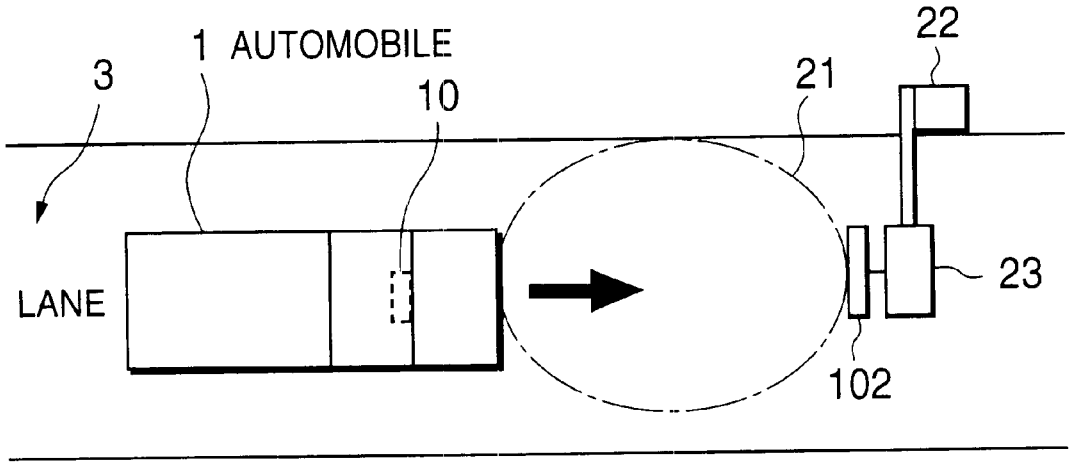
FIG.1 PRIOR ART
FIG. 1 is a plan view showing an example of a conventional ETC system.
Figure 2:
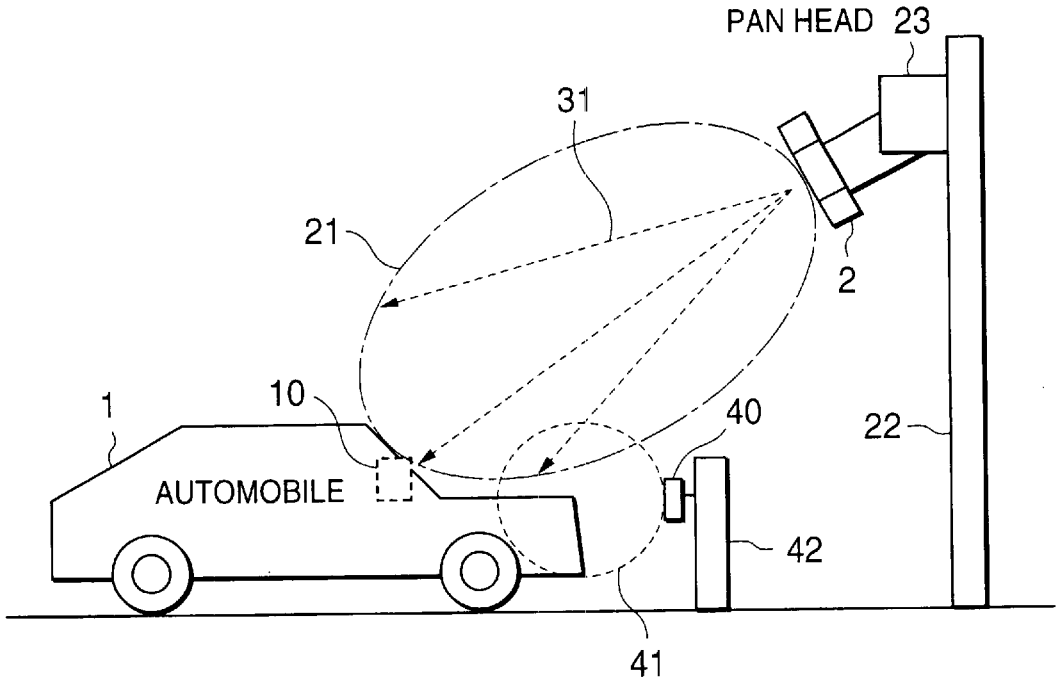
FIG. 2 is a side view of an ETC system according to one embodiment.
Figure 3:
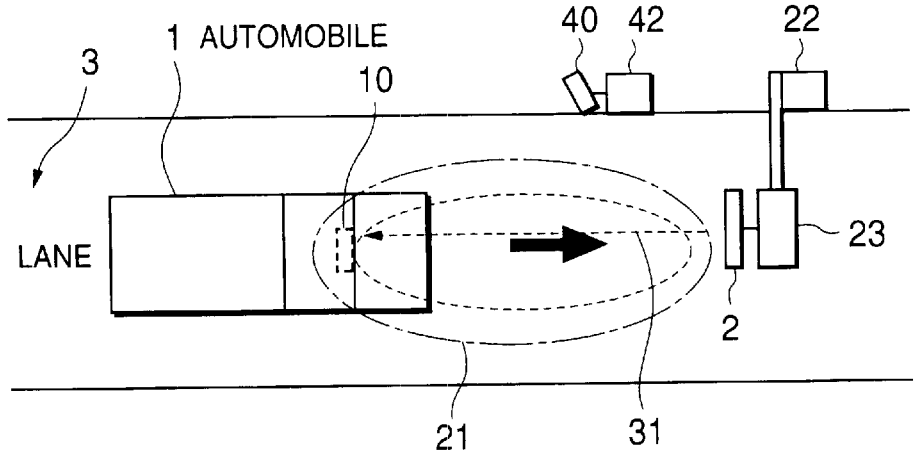
FIG. 3 is a top plan view of FIG. 2.

FIG. 2 is a side view showing an electronic toll collection (ETC) system according to one embodiment of the present invention. FIG. 3 is a top plan-view showing the ETC system in FIG. 2.

Referring to FIGS. 2 and 3 showing the ETC system, an automobile 1 on which an ETC on-vehicle equipment 10 is mounted advances in the center of a lane 3 toward the portion below an antenna apparatus 2 provided over the lane 3. The antenna apparatus 2 has a radio beam emitted area 21 of an integrated antenna, and also has a light emitted area of visible light 31 emitted by an integrated light emitting unit. The light emitted area of the visible light 31 needs to be included in the center in the radio beam emitted area 21, as will be described later.

The antenna apparatus 2 is attached to a pan head 23 which is provided for an arm portion extending over the lane 3 from a column 22 that stands on the side of the lane 3. The pan head 23 exists over the center line of the lane 3, can move a radiated direction of the radio wave and an emitted direction of light in the antenna apparatus 2, and can properly control and fix the direction of the antenna apparatus 2.

Since the visible light must be recognized by an operator without stimulus, preferably, the intensity of emitted light is varied depending on ambient brightness in the case of day, night, evening, or cloudy sky.

An emitted period of the visible light may be continuous. However, if the visible light starts to be emitted in conjunction with the ETC system when the antenna apparatus 2 detects that the automobile 1 enters the lane 3, costs on electric power, etc. can be reduced.

A sensor 40 has a sensor area 41 for detecting that the automobile 1 enters the lane 3, and is installed at a column 42 which stands on the side of the lane 3. In this case, if a distance between the sensor 40 and the antenna apparatus 2 is proper, the emission of the light by the antenna apparatus 2 can be started by a detecting signal from the sensor 40. Therefore, the emission of light can be controlled independently of the ETC system.

Figure 4:
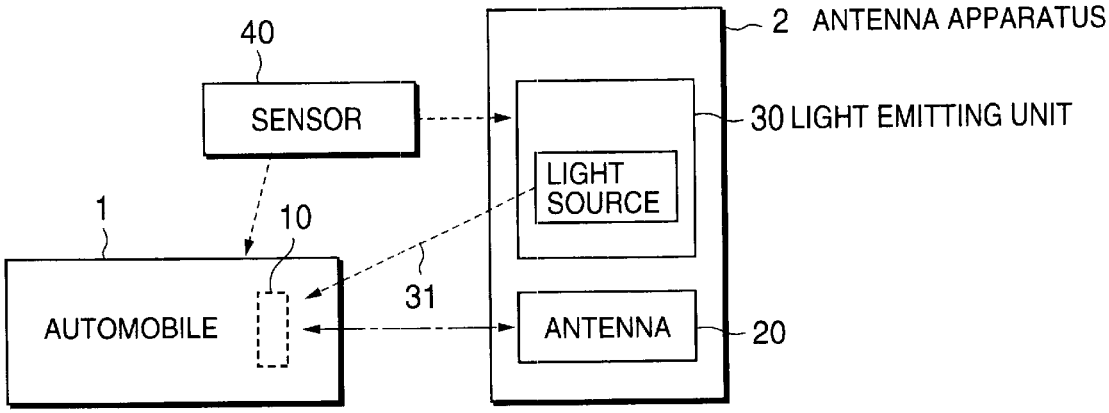
FIG. 4 is a block diagram showing a sensor and an antenna apparatus in FIG. 2 according to the embodiment.

FIG. 4 is a block diagram showing the relationship between the sensor 40 and the antenna apparatus 2 according to one embodiment.

Referring to FIG. 4, the advancing automobile 1 has the ETC on-vehicle equipment 10, and the antenna apparatus 2 has an antenna 20 and a light emitting unit 30. When the sensor 40 senses the automobile 1 on the lane, it informs the light emitting unit 30 in the antenna apparatus 2 of such a fact. The light emitting unit 30 drives a light source when the entrance of the automobile 1 is informed from the sensor 40, and it emits the visible light 31 having an emitted area to the automobile 1. The antenna 20 starts communication and the communication start period is independent of an emitted time of the visible light 31.

To accomplish the object of the present invention, generally, it is set that the sensor 40 detects the automobile 1 and emits the visible light 31 to it, prior to the start of communication by the antenna 20. A driver of the automobile 1 to which the visible light 31 is emitted can control the automobile 1 to set the ETC on-vehicle equipment 10 in the center of the emitted area of the visible light 31. Therefore, if the visible light 31 is not emitted when the automobile 1 passes through the sensor 40, a function of the ETC system can be certainly executed.

Figure 5:
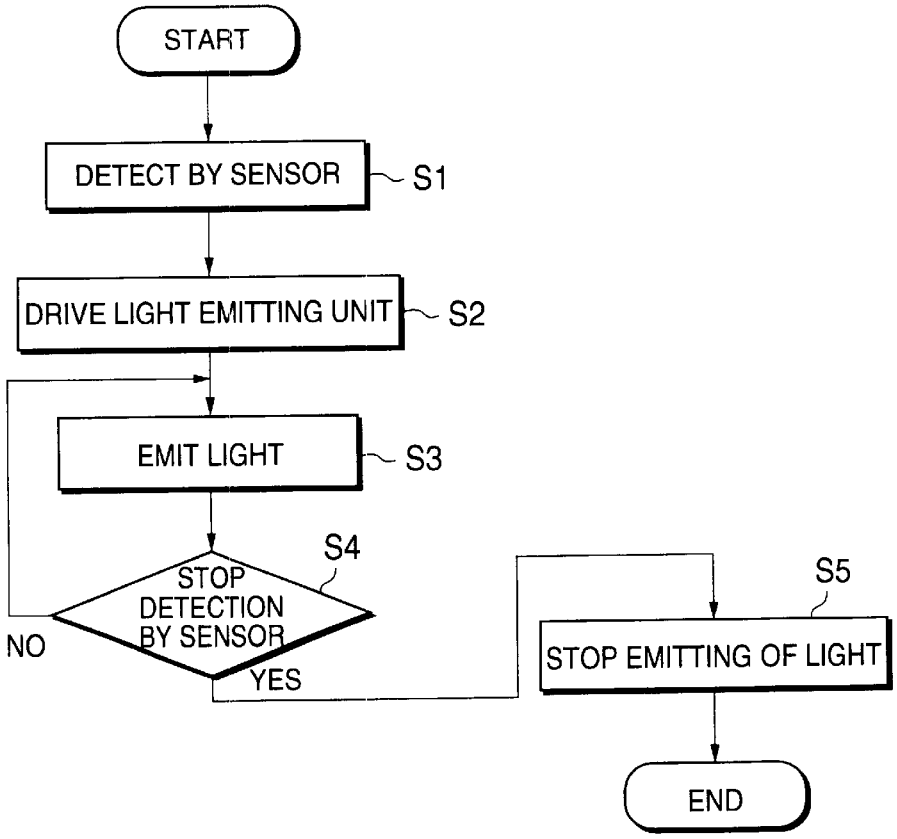
FIG. 5 is a flowchart showing a main procedure in FIG. 4.

Next, a main procedure of the system in FIG. 4 will be described with reference to FIG. 5.

First, the sensor 40 detects that the automobile 1 enters the lane 3 (step S1), and such a fact is informed to the light emitting unit 30. The light emitting unit 30 starts to be driven by information on the detection (step S2). The light source is driven, thereby starting to emit the visible light 31 (step S3). The emission of the visible light 31 in step S3 is continued until the sensor 40 informs the stop of the detection (during NO in step S4 and step 3 returned), and when it informs the stop of YES in step S4, the emission stops (step S5).

The external appearance of the antenna apparatus 2 according to one embodiment of the present invention will be described with reference to FIG. 6.

Figure 6:
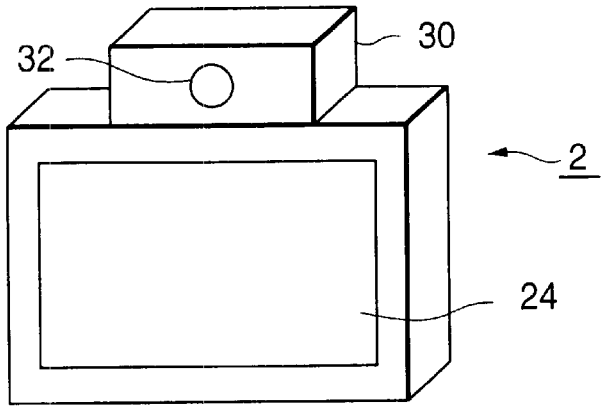
FIG. 6 is a perspective view showing an external appearance of the antenna apparatus in the present invention.

The antenna apparatus 2 shown in FIG. 6 comprises a radio wave radiating surface 24 constituting an integrated antenna (not shown) on a surface of one rectangular casing, and the light emitting unit 30 which is the other small rectangular-casing on the top of the one rectangular casing. The light emitting unit 30 shown in FIG. 6 comprises a light source unit 32 on the same surface as the radio wave radiating surface 24. The light source unit 32 emits visible light having a light emitted area which is circular upon emitting the visible light to a wall opposed to the antenna apart therefrom by a predetermined distance.

Figure 7A:
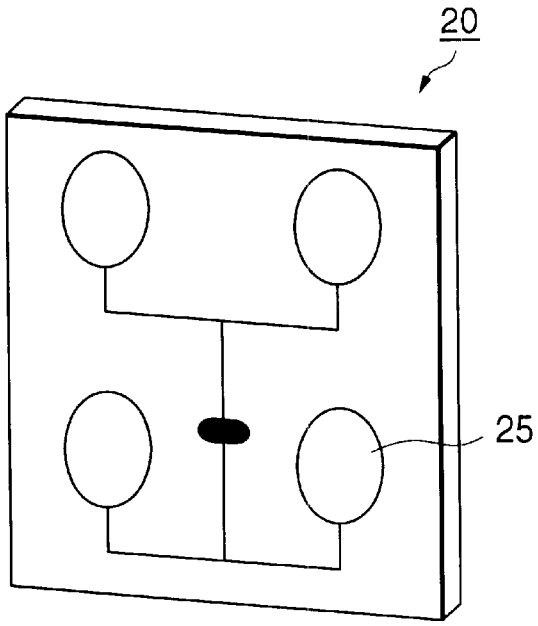
FIG. 7A is a perspective view showing one external appearance of a patch antenna serving as a planar antenna.
Figure 7B:
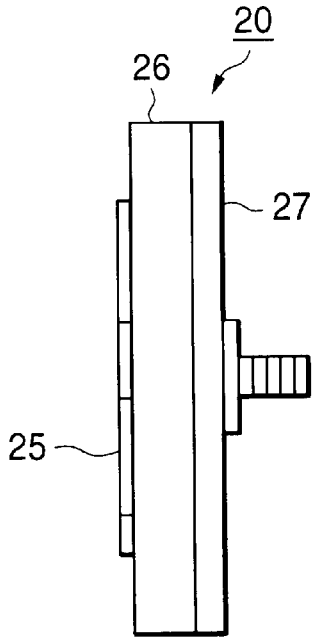
FIG. 7B is a side view showing one structure of the planar antenna in FIG. 7A.

Referring to FIGS. 7A and 7B, the structure of the antenna 20 shown in FIG. 4 according to one embodiment will be described below.

As shown in FIG. 7A, the antenna is a planar antenna 20 and, thereon, disc-shaped patch antennas 25 made of a copper foil are arranged at four corners of a rectangle to be formed on the plane. The two patch antennas are connected by a microstrip line made of the copper foil on the upper and lower sides, respectively, and the microstrip lines are connected in the center point. Further, feed units arranged to the center point of the microstrip lines feed electric power in parallel. An emitting element used for the planar antenna 20 can use rectangle antennas such as a microstrip line antenna and a slot antenna, in addition to the circular patch antenna 25. Instead of the planar antenna 20, various antennas such as a horn antenna, lens antenna, parabola antenna, cross dipole array with reflection plate, and helical antenna can be employed.

In the planar antenna 20 shown in FIG. 7B, the patch antennas 25 and the microstrip lines connecting them are disposed on a dielectric substrate 26. Normally, the dielectric substrate 26 uses a Teflon plate, a modified BT resin substrate, or a glass epoxy substrate, etc. The rear side of the dielectric substrate 26 is overlaid with a ground plane 27. A connector is provided for the center of the rear side, and is connected to the feed unit of the patch antenna 25, thereby being externally fed.

Figure 8:
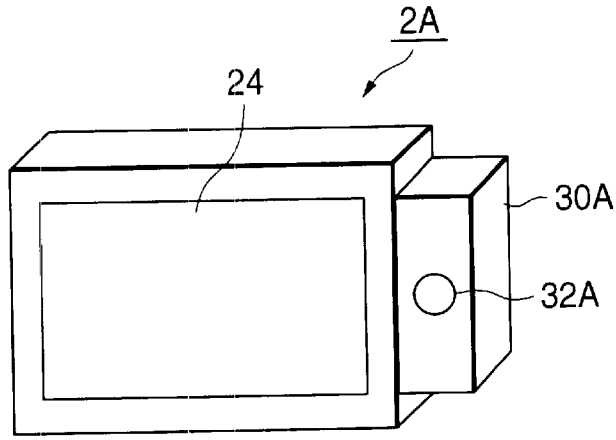
FIG. 8 is a perspective view showing one example of the external appearance of an antenna apparatus in which the position of a light emitting unit in FIG. 6 is modified.

Next, referring to FIG. 8, a description is given of an antenna apparatus 2A in which a light emitting unit 30A is arranged at the position different from that in FIG. 6. Components shown in FIG. 8 and functions thereof are the same as those in FIG. 6, except for that the light emitting unit 30A is arranged on the right of the radio wave radiating surface 24, and the description is omitted. Although the light source unit 32 of the light emitting unit 30 is arranged on the upper side of the radio wave radiating surface 24 in FIG. 6, it may be arranged on any side of upper, lower, right, and left sides. Also, a plurality of the light source units 32 may also be placed.

Next, a description is given of the relationship between the light emitted area of the visible light of the light emitting unit and a radio beam emitted area of the radio wave which is radiated from the radio wave radiating surface. Specifically, the interrelationship can be summarized in the three following points. According to a first point, the light emitted area is narrower than the radio beam emitted area. According a second point, the central axis of the light emitted area substantially coincides with the central axis of the radio beam emitted area. According to a third point, the light emitted area and the radio beam emitted area can be applied to the ETC on-vehicle equipment which is mounted on any type of automobiles such as a passenger car, a bus, and a truck.

Figure 9:
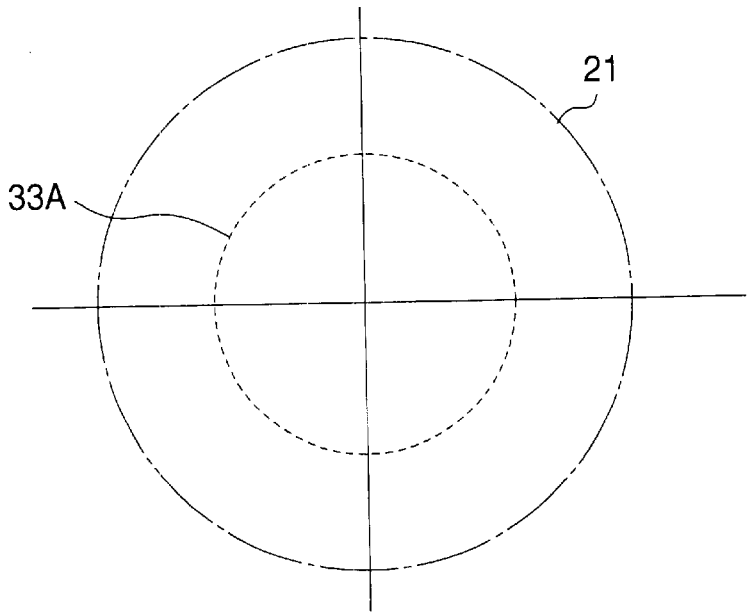
FIG. 9 is an illustrative view of one example of a pattern of a cross sectional surface showing one light emitted area in the antenna apparatus in FIG. 6 or FIG. 8.

FIG. 9 shows a cross-sectional view of an emitted area 33A of the visible light of the light emitting unit 30A shown in FIG. 8 and the radio beam emitted area of the radio wave which is radiated from the radio wave radiating surface 24. The light emitting unit 30 shown in FIG. 6 is the same as the light emitting unit 30A. More specifically, the cross section of the light emitted area 33A is substantially circular when the visible light is emitted to the wall opposed to the antenna apart therefrom by a predetermined distance. Also, the cross section substantially coincides with the radio beam emitted area 21 in the center and is included in the radio beam emitted area 21.

Figure 10:
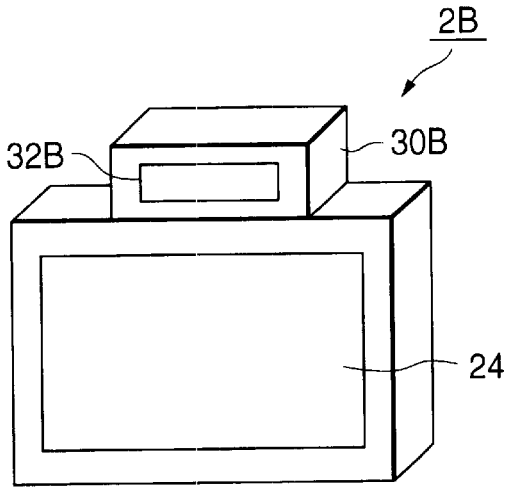
FIG. 10 is a perspective view showing one example of the external appearance of an antenna apparatus in which the shape of a light source unit in FIG. 6 is modified.

Sequentially, referring to FIG. 10, an antenna apparatus 2B has a light emitting unit 30B, instead of the light emitting unit 30 in FIG. 6. The light emitting unit 30B comprises a rectangular light source unit 32B which is laterally long. The light source unit 32B may be arranged on the lower side of the radio wave radiating surface 24, the right side, or the left side instead of the upper side. Further, a rectangular light source unit which is vertically long can be provided on the right or the left. In other words, the light source unit may be provided at least on one position.

Figure 11:
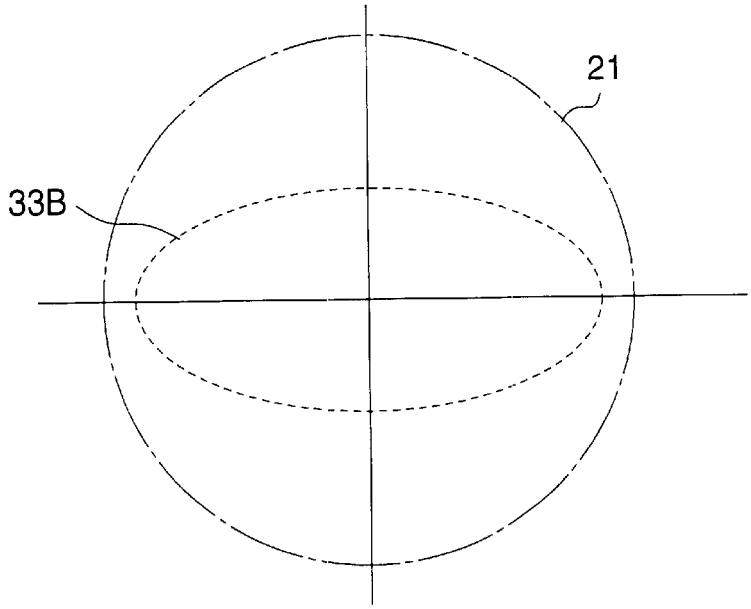
FIG. 11 is an illustrative view of one example of a pattern of a cross section showing a light emitted area in the antenna apparatus in FIG. 10.

FIG. 11 shows a cross-sectional view of the light emitted area 33B of the visible light which is emitted by light source unit 32B shown in FIG. 10. As shown in FIG. 10, the light emitted area 33B has an elliptical shape which is laterally long in cross section. In this case, the light emitted area 33B substantially coincides with the radio beam emitted area 21 in the center, and is included in the radio beam emitted area 21. In the case of the rectangular light source unit which is vertically long and is arranged on the right or left of the radio wave radiating surface 24, obviously, the light emitted area has an elliptical shape which is vertically long in cross section.

Figure 12:
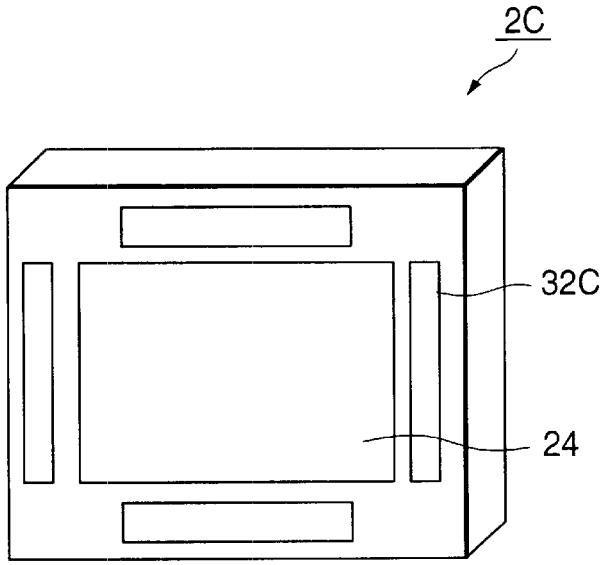
FIG. 12 is a perspective view showing one example of the external appearance of an antenna apparatus having laterally long light source units on upper, lower, right, and left sides in the present invention.

FIG. 12 shows an antenna apparatus 2C in which a long light source units 32C are arranged on four sides of the upper, lower, right, and left ones in the rectangular radio wave radiating surface 24.

Figure 13:
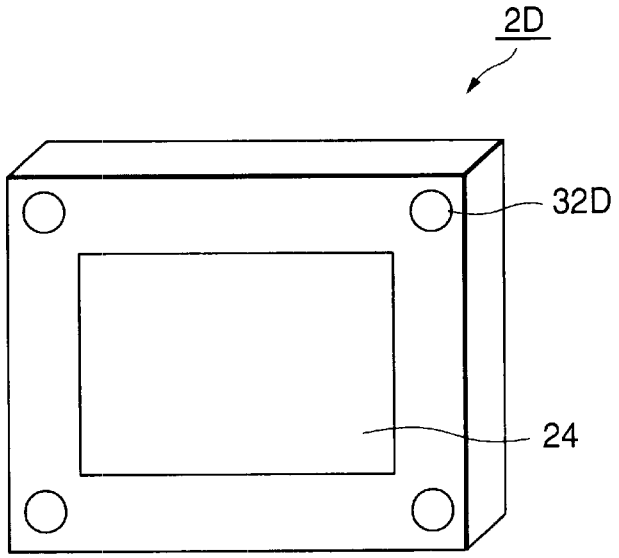
FIG. 13 is a perspective view of one example of the external appearance of an antenna apparatus having circular light source units on four corners thereof in the present invention.

FIG. 13 shows an antenna apparatus 2D in which circular light source units 32D are arranged on the four corners on diagonal lines in the rectangular radio wave radiating surface 24.

Figure 14:
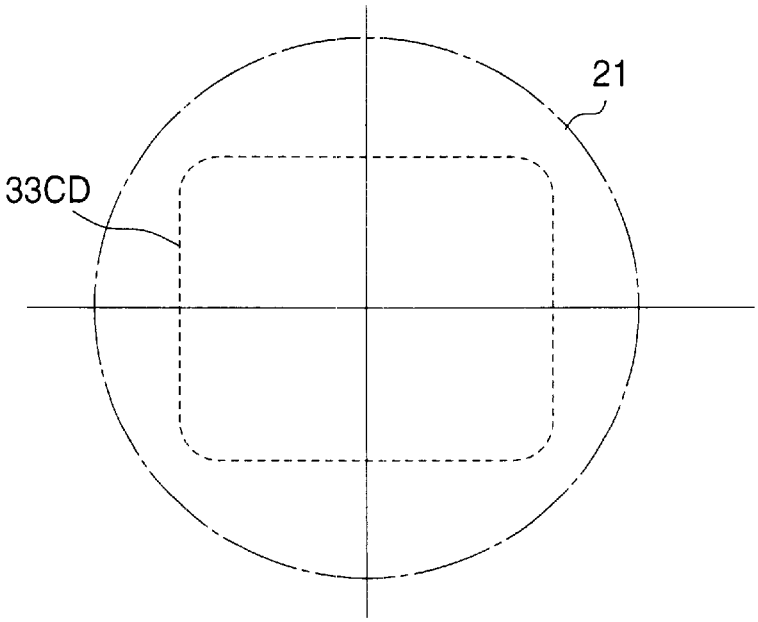
FIG. 14 is an illustrative view of one example of a pattern of a cross section showing a light emitted area in the antenna apparatus in FIG. 12 or FIG. 13.

FIG. 14 shows one cross-sectional view of a light emitted area 33CD of the visible light which is emitted by the light source unit 32C or 32D shown in FIG. 12 or FIG. 13. As shown in FIG. 14, the light emitted area 33CD has a shape which is obtained by cutting off four corners from a rectangle. In this case, the light emitted area 33CD coincides with the radio beam emitted area 21 in the center, and is included in the radio beam emitted area 21 in the center.

Figure 15:
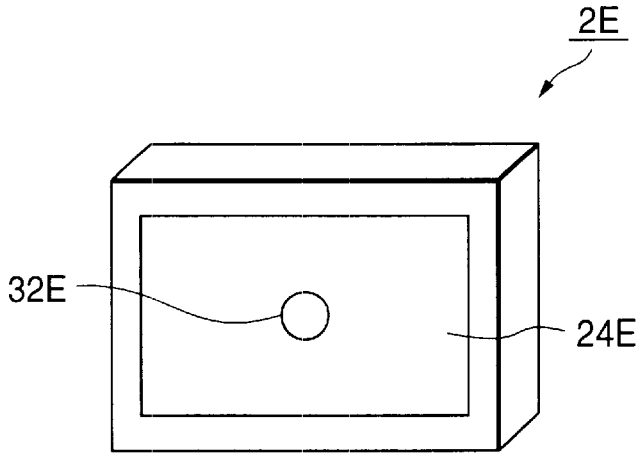
FIG. 15 is a perspective view of one example of the external appearance of an antenna apparatus having a circular light source units in the center of thereof in the present invention.

Next, FIG. 15 shows an antenna apparatus 2E in which a circular light source unit 32E is arranged in the center of a rectangular radio wave radiating surface 24E.

Figure 16:
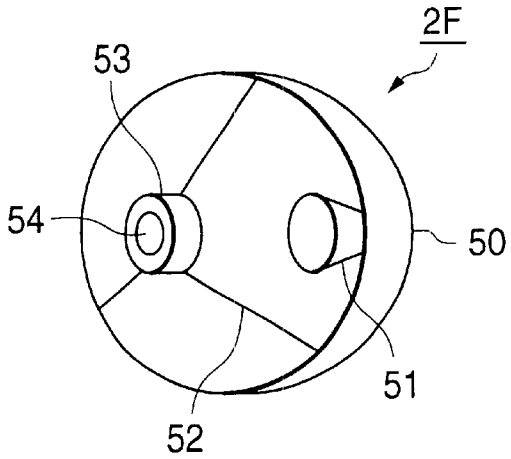
FIG. 16 is a perspective view of one example of the external appearance of an antenna apparatus using a parabola antenna in the present invention.

FIG. 16 shows an antenna apparatus 2F in which a horn 51 is disposed in the center of a parabola reflection mirror 50. In the parabola reflection mirror 50, a sub-reflector 53 which is held by three supporters 52 is in the center in front of the antenna apparatus 2F, and a light source unit 54 is provided in the center of the sub-reflector 53.

An emitted area of the visible light shown in FIG. 15 or FIG. 16 has a substantially circular cross-section as shown in FIG. 9, coincides with the radio beam emitted area 21 in the center, and is in the center of the radio beam emitted area 21.

Next, a description is given of an ETC system in, for example, a car park, etc., in which a lane is opened/closed by a crossing gate.

Figure 17:
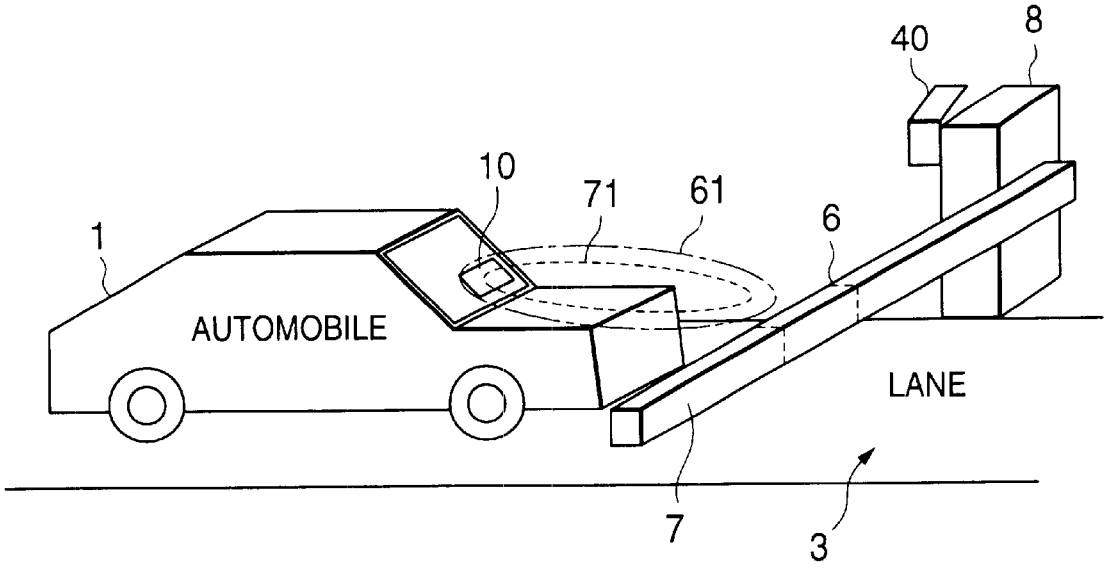
FIG. 17 is a perspective view showing a system using an antenna apparatus mounted on a crossing gate according to another embodiment of the present invention.

FIG. 17 is a perspective view of an ETC system in which a crossing gate 7 having an antenna apparatus 6 is provided in front of an automobile 1 having an ETC on-vehicle equipment 10 in a toll gate according to one embodiment.

As shown in FIG. 17, the crossing gate 7 prevents the passage of the automobile 1 over the lane 3 through which the automobile 1 passes, and is supported rotatably or vertical-movably to a column 8. An antenna constituting the antenna apparatus 6 provided on the crossing gate 7 emits radio waves having a radio beam emitted area 61. And, after the automobile 1 is subjected to the electronic toll collection by communication with the ETC on-vehicle equipment 10, the automobile 1 can pass through the toll gate by raising the crossing gate 7 caused by driving the moving structure of the column 8.

Figure 18:
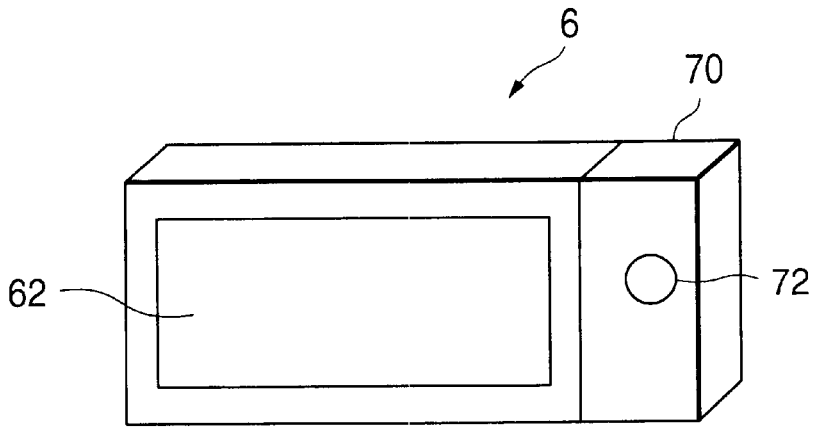
FIG. 18 is a perspective view of one example of the external appearance of the antenna apparatus mounted on the crossing gate in FIG. 17.

FIG. 18 shows the antenna apparatus 6 in FIG. 17. The antenna apparatus 6 shown in FIG. 18 has a radio wave radiating surface 62 constituting an integrated antenna (not shown) on a surface of one rectangular casing, and a light emitting unit 70 which is another small rectangular casing on the right of the one rectangular casing. The light emitting unit 70 comprises a light source unit 72 for emitting visible light having an circular-cross-sectional emitted area on the same surface of the radio wave radiating surface 62.

Referring to FIGS. 17 and 18, one embodiment will be described below.

In the system according to the embodiment, similarly to the case in FIGS. 2 to 5, the antenna apparatus 6 integrates the light emitting unit 70; And, when the sensor 40 detects that the automobile 1 enters the lane 3, the light source unit 72 in the light emitting unit 70 emits visible light to an emitted area 71. The emitted area 71 of the visible light is in the center of the radio beam emitted area 61 whose beam is emitted from the radio wave radiating surface 62. A driver moves the ETC on-vehicle equipment 10 mounted on the automobile 1 into the emitted area 71 of the visible light, thereby locating the ETC on-vehicle equipment 10 in the center of the radio beam emitted area 61.

Figure 19:
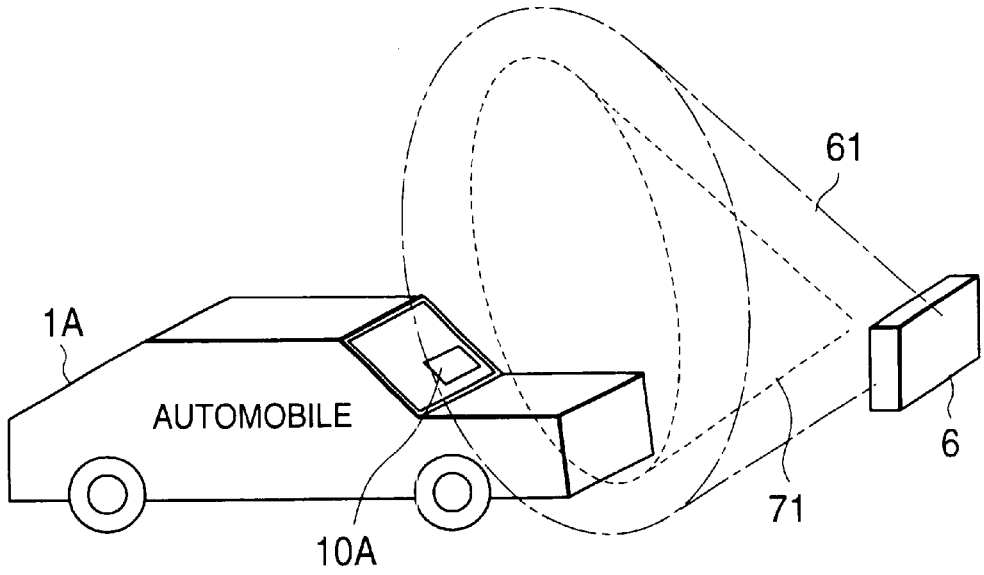
FIG. 19 is a perspective view showing the emitted area of visible light in FIG. 17 which is applied to a passenger car according to the embodiment.
Figure 20:
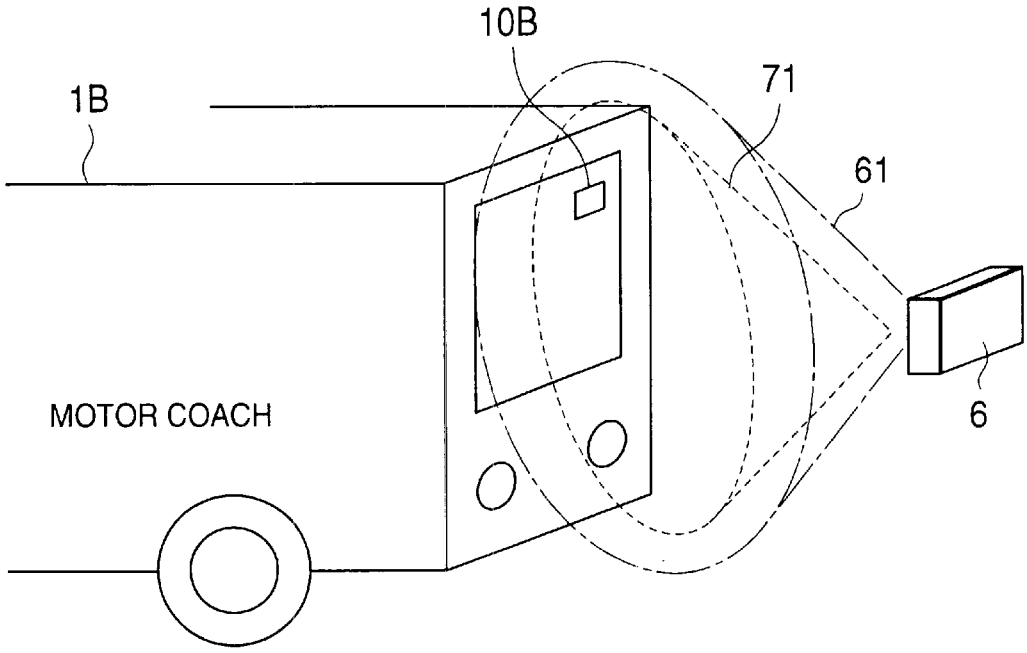
FIG. 20 is a perspective view showing the emitted area of the visible light in FIG. 17 which is applied to a motor coach according to the embodiment.

FIGS. 19 and 20 show the relationship between the radio beam emitted area 61 and the light emitted area 71 in the cases in which the antenna apparatus 6 is in front of a passenger car 1A and in which it is in front of a motor coach 1B, respectively. As shown in the Figures, the light emitted area 71 of the visible light has a vertically long area and the visible light can be emitted to ETC on-vehicle equipment 10A and 10B having different heights which are in the center of the radio beam emitted area 61. If the ETC system can detect the size of the automobile, the ETC system can control a pan heads and can change an angle of elevation of the antenna apparatus, the light emitting unit rotates in conjunction with the antenna, thereby reducing the emitted area.

Figure 21:
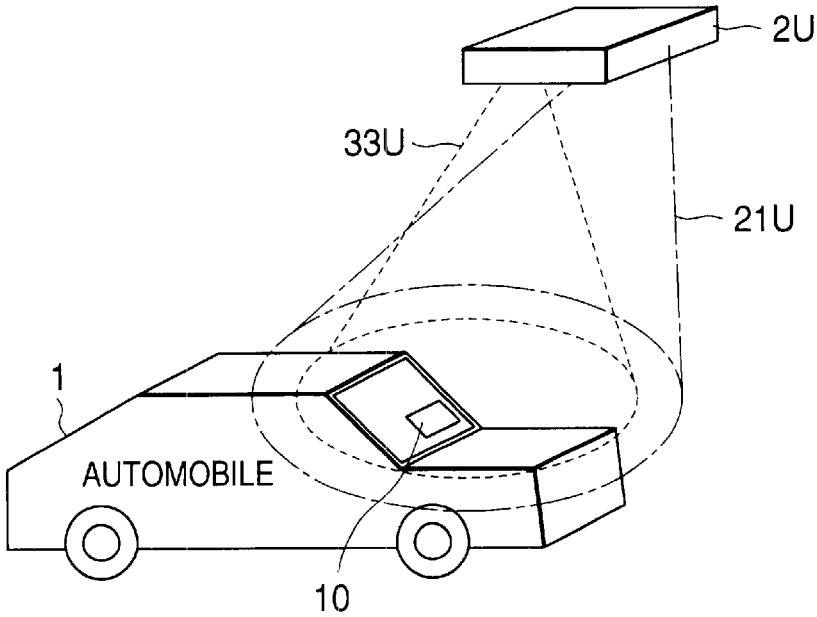
FIG. 21 is a perspective view showing an antenna apparatus set over according to the embodiment of the present invention.

FIG. 21 shows an example in which an antenna apparatus 2U is arranged over the lane. Similarly to the above description, a light emitted area 33U of the visible light is in the center of a radio beam emitted area 21U and the visible light must be emitted to the ETC on-vehicle equipment 10. In this case, preferably, the light can be emitted to the ETC on-vehicle equipment having different heights such as the passenger car and the motor coach.

Figure 22:
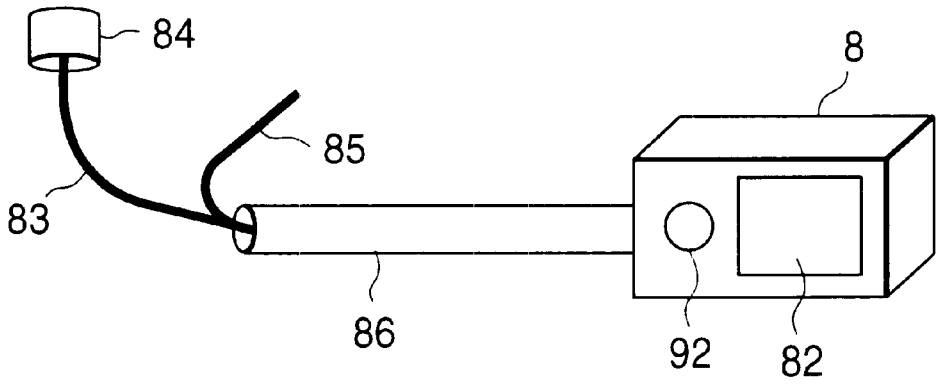
FIG. 22 is a perspective view showing a handy-type antenna apparatus according to another embodiment of the present invention.
Figure 23:
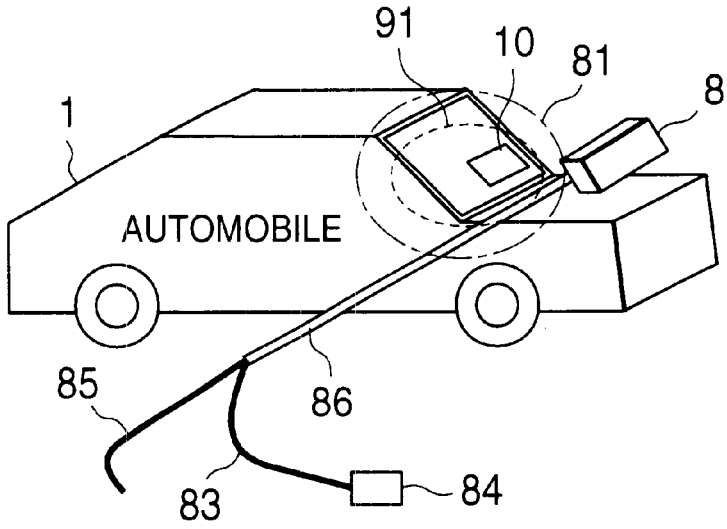
FIG. 23 is a perspective view showing a using method of the antenna apparatus shown in FIG. 22 according to another embodiment of the present invention.

Next, referring to FIGS. 22 and 23, a description is given of a handy-type antenna apparatus below. FIG. 22 is a perspective view showing a handy-type antenna apparatus 8 according to one embodiment, and FIG. 23 is a perspective view showing one example in the case of using the antenna apparatus 8 according to the embodiment.

The antenna apparatus 8 integrates an antenna and a light emitting unit as mentioned above. A radio wave radiating surface 82 of the antenna and a light source unit 92 in the light emitting unit are on the same plane. A light emitted area 91 of the visible light is in the center in a radio beam emitted area 81, and the light is emitted to the ETC on-vehicle equipment 10. The antenna apparatus 8 is connected to one end of a coaxial cable 83 for communication in the ETC system. A coaxial connector 84 is connected to the other end of the coaxial cable 83. Since a power source cable 85 is connected, a flexible pipe-shaped arm-portion 86 for accommodating therein the coaxial cable 83 and the power source cable 85 is coupled to the antenna apparatus 8 for the sake of convenience that the antenna apparatus 8 is handy one.

As shown in the Figures, in the automobile 1, a switch is turned on at a distance approximately 10 cm to 1 m in front of the ETC on-vehicle equipment 10. The radio wave radiating surface 82 of the antenna is manually directed to the ETC on-vehicle equipment 10 so that the light source unit 92 emits the visible light to the ETC on-vehicle equipment 10, thereby performing communication through the ETC system.

If the light emitted area 91 is equivalent to the radio beam emitted area 81 or is narrower than the radio beam emitted area 81, similarly to the above description, the ETC on-vehicle equipment 10 is within the light emitted area 91. Thereby the ETC on-vehicle equipment 10 can accurately execute the communication for the ETC system. In this case, an operator of the antenna apparatus 8 works for the purpose of accurate communication, instead of the driver of the automobile 1.

The above-described handy-type antenna apparatus has the following merits.

According to a first merit, a toll can be easily collected unless the antenna apparatus for ETC on the system main body is provided on the lane at toll booths of a toll road, a toll car park, etc. According to a second merit, a toll can be collected without any additional operation by driver, even in such the case of the lane on which the ETC system provided is non-operational as the vehicle cannot pass through the lane due to a communication error and it is incommunicable because of the failure of the antenna apparatus. According to a third merit, the above antenna apparatus can be readily used as a system for a toll process with low costs by cards such as a credit card in a service station or a drive-through.

In the foregoing description, with reference to the drawings, if the sensor detects the automobile, the visible light is emitted to the center in the radio beam emitted area to be formed by the radio wave through the antenna. However, no sensor may be used. For example, the visible light may be continuously emitted, alternatively, a system is originally equipped independently of the ETC system but is operated in conjunction with the ETC system and the visible light can be efficiently emitted in accordance with a timing of communication by the radio wave.

Also, the foregoing description exemplifies forms and materials of the antenna apparatus, antenna, and light emitting unit and shapes of the radio wave radiating surface and the light source unit. However, they are examples and other forms and shapes may be used. If the position of the light source unit is controlled so that the light emitted area is substantially in the center of the radio beam emitted area and the ETC on-vehicle equipment in the light emitted area accurately communicates with the antenna, the light source may be located anywhere in the radio wave radiating surface and the proximity thereof and any number of light source units may be used.

While the present invention has been described in detail in conjunction with the several preferred embodiments thereof, the present invention is not limited to the foregoing description but can be modified in various manners without departing from the scope of the invention set forth in appended claims.

The function and structure may be modified without departing from the above-functions and the present invention is not limited to the above description.

As described above, according to the present invention, the following advantages can be obtained.

A first advantage is to reduce communication errors in the ETC system and to improve the reliability. The reason is why the antenna apparatus integrating the antenna for emitting the radio wave comprises the light emitting unit for emitting the visible light to the center of the radio beam emitted area of the radio wave. The driver of the automobile and the operator of the handy-type antenna apparatus operate the ETC on-vehicle equipment by the emitted light so that it enters the light emitted area of the visible light. Therefore, the ETC on-vehicle equipment can be positioned substantially in the center in the radio beam emitted area of the radio wave and the conditions for communication are properly adjusted.

A second advantage is to ensure the security. The reason is why the communication errors are reduced by the first advantage. More specifically, if the communication error arises due to an excessively high speed and the crossing gate is closed, there is a danger that the automobile is cracked against the crossing gate. However, the communication conditions are improved and, therefore, crack opportunities can be reduced.

A third advantage is that the operator can feel at ease. The reason is why the operator can recognize that the visible light is emitted to the ETC on-vehicle equipment mounted on the automobile, thereby also recognizing that the ETC on-vehicle equipment accurately communicates with the ETC system.

What is claimed is:

1. An electronic toll collection system an antenna apparatus comprising:

an antenna through which a radio beam is emitted to have a predetermined directionality; and a light emitting unit having an emitted area of visible light in the center of a radio beam emitted area of said antenna, wherein said antenna apparatus is held over a lane through which an automobile passes and, when a radio beam emitted area of an antenna which said antenna apparatus has is directed to on-vehicle equipment for electronic toll collection, the light source of said light emitting unit emits visible light to the center in said radio beam emitted area.

2. An electronic toll collection system according to claim 1, further comprising:

a sensor for detecting an entering direction of said automobile which enters the lane in front of said antenna, for driving said light emitting unit when the entrance of the automobile is detected, and for emitting the visible light from the light source in said light emitting unit.

3. An electronic toll collection system according to claim 1, wherein the visible light emitted from a light source of said light emitting unit has a shape which is substantially circular when said visible light is emitted to a wall opposed to said antenna apart therefrom by a predetermined distance in said emitted area.

4. An electronic toll collection system of claim 1, wherein the visible light emitted from a light source of said light emitting unit has a shape which is substantially circular when said visible light is emitted to a wall opposed to said antenna apart therefrom by a predetermined distance in said emitted area, said antenna apparatus is rectangular-shaped, and said light source is provided for at least one of four corners of a radio wave radiating surface of said antenna.

5. An electronic toll collection system of claim 1, wherein the visible light emitted from a light source of said light emitting unit has a shape which is substantially circular when said visible light is emitted to a wall opposed to said antenna apart therefrom by a predetermined distance in said emitted area, said antenna apparatus is rectangular-shaped, said light source is provided for at least one of four corners of a radio wave radiating surface of said antenna, and said shape is substantially rectangular in said emitted area of the visible light.

6. An electronic toll collection system of claim 1, wherein the visible light emitted from a light source of said light emitting unit has one of a laterally long shape and a vertically long shape when said visible light is emitted to a wall opposed to said antenna apart therefrom by a predetermined distance in said emitted area.

7. An electronic toll collection system of claim 1, wherein the visible light emitted from a light source of said light emitting unit has one of a laterally long shape and a vertically long shape when said visible light is emitted to a wall opposed to said antenna apart therefrom by a predetermined distance in said emitted area.

8. An electronic toll collection system of claim 1, wherein the visible light emitted from a light source of said light emitting unit has one of a laterally long shape and a vertically long shape when said visible light is emitted to a wall opposed to said antenna apart therefrom by a predetermined distance in said emitted area, said light source of the vertically long shave is provided at least on the upper side and on the lower side of said antenna.

9. An electronic toll collection system of claim 1, wherein the visible light emitted from a light source of said light emitting unit has one of a laterally long shape and a vertically long shape when said visible light is emitted to a wall opposed to said antenna apart therefrom by a predetermined distance in said emitted area, said light sources having the laterally long shape are provided on the upper side and the lower side of said antenna apparatus respectively, said light sources having the vertically long shape are provided on the right side and the left side in said antenna respectively, and a shape in said emitted area of the visible light is rectangular.

10. An electronic toll collection system of claim 1, wherein said antenna has a horn-type antenna and a sub-reflector which is held by a supporter in a parabola reflection mirror and a light source of said light emitting unit is positioned substantially in the center of said sub-reflector.

11. An electronic toll collection system using an antenna apparatus comprising:

an antenna through which a radio beam is emitted to have a predetermined directionality; and a light emitting unit having an emitted area of visible light in the center of a radio beam emitted area of said antenna, wherein said antenna apparatus is provided for a crossing gate which is held to a column to cross the lane through which said automobile passes at the position to prevent the passage of said automobile and, when the radio beam emitted area of the antenna which said antenna apparatus is directed to on-vehicle equipment for electronic toll collection which is mounted on said automobile, the light source of said light emitting unit emits visible light to the center of said radio beam emitted area.

12. An electronic toll collection system according to claim 11, further comprising:

a sensor for detecting that the automobile enters the lane, for driving said light emitting unit when the entrance of the automobile is detected, and for emitting the visible light from the light source in said light source emitting unit.

13. An electronic toll collection system of claim 11, wherein the visible light emitted from a light source of said light emitting unit has a shape which is substantially circular when said visible light is emitted to a wall opposed to said antenna apart therefrom by a predetermined distance in said emitted area.

14. An electronic toll collection system of claim wherein the visible light emitted from a light source of said light emitting unit has a shape which is substantially circular when said visible light is emitted to a wall opposed to said antenna apart therefrom by a predetermined distance in said emitted area, said light source is provided at least on one of an upper side, a lower side, a right side, and a left side in said antenna.

15. An electronic toll collection system of claim 11, wherein the visible light emitted from a light source of said light emitting unit has a shape which is substantially circular when said visible light is emitted to a wall opposed to said antenna apart therefrom by a predetermined distance in said emitted area, said antenna apparatus is rectangular-shaved, and said light source is provided for at least one of four corners of a radio wave radiating surface of said antenna.

16. An electronic toll collection system of claim 11, wherein the visible light emitted from a light source of said light emitting unit has a shape which is substantially circular when said visible light is emitted to a wall opposed to said antenna apart therefrom by a predetermined distance in said emitted area, said antenna apparatus is rectangular-shaped, said light source is provided for at least one of four corners of a radio wave radiating surface of said antenna, and said shape is substantially rectangular in said emitted area of the visible light.

17. An electronic toll collection system of claim 11, wherein the visible light emitted from a light source of said light emitting unit has one of a laterally long shape and a vertically long shape when said visible light is emitted to a wall opposed to said antenna apart therefrom by a predetermined distance in said emitted area.

18. An electronic toll collection system of claim 11, wherein the visible light emitted from a light source of said light emitting unit has one of a laterally long shape and a vertically long shape when said visible light is emitted to a wall opposed to said antenna apart therefrom by a predetermined distance in said emitted area, said light source of the laterally long shape is provided at least on the upper side and on the lower side of said antenna.

19. An electronic toll collection system of claim 11, wherein the visible light emitted from a light source of said light emitting unit has one of a laterally long shape and a vertically long shape when said visible light is emitted to a wall opposed to said antenna apart therefrom by a predetermined distance in said emitted area, said light source of the vertically long shape is provided at least on the upper side and on the lower side of said antenna.

20. An electronic toll collection system of claim 11, wherein the visible light emitted from a light source of said light emitting unit has one of a laterally long shape and a vertically long shape when said visible light is emitted to a wall opposed to said antenna apart therefrom by a predetermined distance in said emitted area, said light sources having the laterally long shape are provided on the upper side and the lower side of said antenna apparatus respectively, said light sources having the vertically long shape are provided on the right side and the left side in said antenna respectively, and a shape in said emitted area of the visible light is rectangular.

21. An electronic toll collection system of claim 11, wherein said antenna has a horn-type antenna and a sub-reflector which is held by a supporter in a parabola reflection mirror and a light source of said light emitting unit is positioned substantially in the center of said sub-reflector.

22. An electronic toll collection method, characterized in that said method uses an antenna apparatus comprising:

an antenna through which a radio beam is emitted to have a predetermined directionality; and a light emitting unit having an emitted area of visible light in the center of a radio beam emitted area of said antenna, said antenna apparatus comprising a portable, hand-held apparatus which is connected to one end of an arm portion having therein a coaxial cable and a power source cable, said method comprising:

when the emitted area of the visible light which is emitted by the light emitting unit that said antenna apparatus has is directed to the on-vehicle equipment for electronic toll collection on the automobile entering the lane for collecting a toll, electronic toll collection is performed by using the radio beam emitted through the antenna.

23. An electronic toll collection system using an antenna apparatus comprising:

an antenna through which a radio beam is emitted to have a predetermined directionality; and a light emitting unit having an emitted area of visible light in the center of a radio beam emitted area of said antenna, wherein the visible light emitted from a light source of said light emitting unit has a shape which is substantially circular when said visible light is emitted to a wall opposed to said antenna apart therefrom by a predetermined distance in said emitted area, and said antenna apparatus is held over a lane through which an automobile passes and, when a radio beam emitted area of an antenna which said antenna apparatus has is directed to on-vehicle equipment for electronic toll collection, the light source of said light emitting unit emits visible light to the center in said radio beam emitted area, said light source of the laterally long shave is provided at least on the upper side and on the lower side of said antenna.

* * * * *